US012703925B2

(12) United States Patent
von Vopelius et al.

(10) Patent No.: US 12,703,925 B2
(45) Date of Patent: Aug. 11, 2026

(54) ELECTROLYTE AND METHOD FOR PRODUCING CHROMIUM LAYERS

(71) Applicants: Maschinenfabrik Kaspar Walter GmbH & Co. KG, Krailing (DE); Vopelius Chemie AG, Leipzig (DE)

(72) Inventors: Thilo von Vopelius, Leipzig (DE); Peter Schaale, Leipzig (DE); Christoph Gschossmann, Übersee (DE)

(73) Assignees: Maschinenfabrik Kaspar Walter GmbH & Co. KG, Krailing (DE); Vopelius Chemie AG, Leipzig (DE)

( * ) Notice: Subject to any disclaimer, the term of this patent is extended or adjusted under 35 U.S.C. 154(b) by 213 days.

(21) Appl. No.: 17/416,593

(22) PCT Filed: Dec. 12, 2019

(86) PCT No.: PCT/EP2019/084877
§ 371 (c)(1),
(2) Date: Nov. 24, 2021

(87) PCT Pub. No.: WO2020/126817
PCT Pub. Date: Jun. 25, 2020

(65) Prior Publication Data

US 2023/0160083 A1 May 25, 2023

(30) Foreign Application Priority Data

Dec. 21, 2018 (DE) ..... 102018133532.6

(51) Int. Cl.

| | |
|---|---|
| ***C25D 7/00*** | (2006.01) |
| ***C25D 3/06*** | (2006.01) |
| ***C25D 3/10*** | (2006.01) |
| ***C25D 17/10*** | (2006.01) |

(52) U.S. Cl.
CPC ..... *C25D 7/00* (2013.01); *C25D 3/06* (2013.01); *C25D 3/10* (2013.01); *C25D 17/10* (2013.01)

(58) Field of Classification Search
None
See application file for complete search history.

(56) References Cited

U.S. PATENT DOCUMENTS

| | | | | | |
|---|---|---|---|---|---|
| 1,589,988 | A * | 6/1926 | Schwartz | ..... | C25D 17/10 205/284 |
| 2,377,229 | A * | 5/1945 | Harford | ..... | C25D 3/06 205/267 |
| 4,461,680 | A | 7/1984 | Lashmore | | |
| 4,466,865 | A * | 8/1984 | Tomaszewski | ..... | C25D 21/18 204/291 |
| 2003/0015433 | A1* | 1/2003 | Tsuchida | ..... | C25D 21/18 205/291 |
| 2012/0118749 | A1 | 5/2012 | Pearson | | |
| 2012/0279869 | A1* | 11/2012 | Murakami | ..... | C25D 3/08 205/284 |

FOREIGN PATENT DOCUMENTS

| | | | | | |
|---|---|---|---|---|---|
| DE | 102014116717 | A1 | 5/2016 | | |
| EP | 3378973 | A1 * | 9/2018 | ..... | C25D 3/06 |
| JP | H0598496 | A | 4/1993 | | |
| JP | H08120500 | A | 5/1996 | | |
| JP | H08225997 | A | 9/1996 | | |
| JP | 2000104199 | A | 4/2000 | | |
| JP | 2001500195 | A | 1/2001 | | |
| JP | 2007162123 | A | 6/2007 | | |
| JP | 2008143169 | A | 6/2008 | | |
| JP | 2012511099 | A | 5/2012 | | |
| JP | 2013216932 | A | 10/2013 | | |
| JP | 2013543062 | A | 11/2013 | | |
| JP | 2017008404 | A | 1/2017 | | |
| JP | 2018003092 | A | 1/2018 | | |
| WO | 2009046181 | A1 | 4/2009 | | |
| WO | WO-2016075287 | A1 * | 5/2016 | ..... | C25D 17/002 |
| WO | WO-2019026578 | A1 * | 2/2019 | ..... | C25D 17/10 |

OTHER PUBLICATIONS

Wo2019026578 translation.*

* cited by examiner

*Primary Examiner* — Louis J Rufo
(74) *Attorney, Agent, or Firm* — Murphy, Bilak & Homiller, PLLC

(57) ABSTRACT

Disclosed is an electrolyte for the electrolytic deposition of chromium as a metal, comprising (a) a chromium (III) salt and (b) metallic chromium, the use of the electrolyte for producing chromium layers on rotationally symmetrical components, in particular gravure printing cylinders, and methods, in which this electrolyte is used.

10 Claims, No Drawings

ELECTROLYTE AND METHOD FOR PRODUCING CHROMIUM LAYERS

TECHNICAL FIELD

The invention relates to an electrolyte for the electrolytic deposition of chromium as a metal, the use of the electrolyte for this purpose, and a method for producing chromium layers.

BACKGROUND

The electrolytic deposition of chromium from Cr(III) containing electrolytes is well known. An electrolyte for the electrolytic deposition of chromium as a metal, which comprises:

(a) a chromium(III) salt, (b) a compound of the formula (I)

ii.

(I)

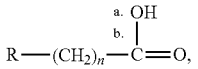

wherein R stands for $NH_2$, OH or $SO_3H$ and n is an integer ranging from 1 to 3, (c) formic acid and (d) at least one additive, is, for example, known from DE 10 2014 116 717 A1. Chromium can be deposed from this electrolyte by means of direct current on the object used as the cathode.

The disadvantage is that, due to the deposition of chromium from the trivalent chromium electrolyte, the concentration of chromium(III) ions will decrease in the electrolyte. Cr(III) can only be added in the form of chromium(III) salts which, however, will lead to successive accumulation of the anion existent in the salt in the electrolyte. Regular dilution with subsequent additional dosage of the other ingredients is therefore necessary.

SUMMARY

Accordingly, the present invention is based on the object to provide an electrolyte where, while electrolysis is taking place, the Cr(III) content is kept more or less constant at least over a longer time period of up to several months, and Cr(III) is subsequently supplied to the electrolyte being depleted of Cr(III), without Cr(VI) being produced in this process.

This is, in accordance with the invention, achieved by an electrolyte for the electrolytic deposition of chromium as a metal, which comprises (a) a chromium(III) salt and (b) metallic chromium.

DETAILED DESCRIPTION

It has been found that, when metallic chromium is inserted into the Cr(III) electrolyte, the chromium(III) content can be kept approximately constant over a long time period of at least several hours up to several months whilst electrolysis is taking place. How long the chromium(III) content can be kept constant depends on the amount of the metallic chromium used and on the conditions of electrolysis, so that the time period can be controlled in a simple and convenient manner by these parameters. In addition, the dissolution of the metallic chromium can be observed. It is assumed-without being bound thereby-that, when Cr(III) is present, cathodic Cr(II) is produced during reduction. This should facilitate the dissolution of the metallic Cr. At the same time, it prevents the formation of Cr(VI) during oxidation, i.e. when metallic chromium is dissolved during electrolysis, Cr(VI) is not produced. Furthermore, electrolytic deposition can be advantageously performed without using a semipermeable membrane. Until now, semipermeable membranes have been used to separate the anode from the cathode so that Cr(VI) is not formed. This is not required with the use of the electrolyte according to the invention since here the formation of Cr(VI) is prevented due to the composition of the electrolyte.

In one embodiment, the metallic chromium can be available in the form of one or more molds in the electrolyte. These are dissolved over a particularly long time period, as stated above, during electrolysis, so that they can subsequently supply the required Cr(III) in a particularly convenient manner. The mold can have a regular or irregular form. The mold can be smooth or porous. Examples of the molds are pieces, nuggets, chunks, plates, ingots, wires and meshes. A powder is not to be regarded as a mold within the meaning of the present invention.

In one embodiment, the electrolyte further contains a sulfate ($SO_4^{2-}$), especially Na sulfate and/or K sulfate, as the component (c). The amount of the sulfate can be 5 mM to 30 mM, for example, 10 mM to 20 mM. By adding sulfate, the aforementioned advantages are especially achieved in a particularly convenient manner.

In a further embodiment, the electrolyte includes (d) a compound of the formula (I)

ii.

(I)

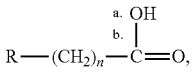

wherein R stands for $NH_2$, OH or $SO_3H$ and n is an integer ranging from 1 to 3, and/or its salts, e.g. salts with monovalent cations such as $Na^+$ and/or $K^+$ or bivalent cations, and/or (e) formic acid and/or its salts, e.g. salts with monovalent cations such as $Na^+$ and/or $K^+$ or bivalent cations.

The formic acid that is possibly present in the electrolyte according to the invention serves, for example, to remove the oxygen produced from the chromium(III) salt by transforming it into $CO_2$ and $H_2O$.

The amount of formic acid and its salt in the electrolyte according to the invention is, for example, 1.0 mol/1 to 3.0 mol/l related to the electrolyte. A particularly convenient removal of oxygen occurs with this amount of formic acid in the electrolyte according to the invention. This indication of amount relates to the electrolyte before the deposition of chromium. In the course of the deposition of chromium, it is possible that the pH value of the electrolyte changes. To set the pH value, additional formic acid can be added. This amount added is not meant to be considered for the amount of formic acid in the electrolyte according to the invention, i.e. prior to the beginning of the deposition.

Preferably, the compound of the formula (I) is glycine, glycolic acid, sodium sulfoacetate, potassium sulfoacetate or a mixture of at least two of these compounds. In the electrolyte according to the invention, the amount of the compound of the formula (I) can be 0.5 mol/1 to 1.5 mol/1 related to the electrolyte.

The compound of the formula (I) can serve to set the pH value of the electrolyte, where the pH value can be set particularly conveniently with the amounts indicated.

In one embodiment of the electrolyte according to the invention, the chromium(III) salt includes an inorganic and/or an organic chromium(III) salt. The term "chromium (III) salt" as used herein is understood to mean any chromium(III) salt with which chromium can be deposed as a metallic layer on objects. Preferably, the inorganic chromium(III) salt is potassium chrome alum, ammonium chrome alum, chromium sulfate, chromium chloride, chromium sulfamate (amido sulfonate), chromium bromide, chromium iodide, chromium phosphate, chromium pyrophosphate (diphosphate), chromium phosphonate, chromium hydroxy sulfate (alkali chromium sulfate), and mixtures of two or more of them. The organic chromium(III) salt can preferably be chromium citrate, chromium formate, chromium oxalate, chromium methanesulfonate, chromium dimethanesulfonate and mixtures of two or more of them.

The amount of the chromium(III) salt conveniently is 0.25 mol/1 to 2.0 mol/1 related to the electrolyte. With these amounts, chromium layers can be produced on metallic objects by electrolytic depositions in a particularly convenient manner.

Furthermore, an additive known per se can be available in the electrolyte as the component (f), as it is usually used in the electrolytic deposition of chromium. Examples of this are wetting agents and complexing agents. These wetting agents cause the reduction of the surface tension, so that it is enabled that $H_2$ bubbles become detached from the cathode. The formation of pores can thereby be prevented in a simple and convenient manner and thus uniform chromium layers produced. N,N-dimethyl-dithiocarbamylpropyl sulfonic acid sodium salt (DPS) can, for example, be used as the complexing agent. When using DPS, particularly good-quality chromium layers are obtained.

The amount of the common additive present in the electrolyte according to the invention can be 0.01 g/l to 2.0 g/l related to the electrolyte. In this process, the amount of the complexing agent can be 0.5 mol/1 to 4.0 mol/1. The amount of the wetting agent can be 0 mol/1 to 0.5 mol/1.

The electrolyte can be used in a method for producing a chromium layer on decorative and technical objects by electrolytic deposition of chromium.

Examples of technical objects are rotationally symmetrical objects such as rods, pistons and cylinders, in particular, gravure cylinders. In this process, the chromium layer proved to be particularly convenient for these objects, especially gravure cylinders, since it meets the high requirements for chromium layers.

The electrolytic deposition of chromium layers can be performed in a manner known per se, e.g. in an electrolysis cell which is filled with the electrolyte. This electrolyte is the aforedescribed electrolyte according to the invention. Anode and cathode are immersed in the electrolyte. When applying a DC voltage to these two electrodes, i.e. anode and cathode, the chromium is deposited on the object to be coated. In this process, this object is used as the cathode, i.e. the object to be coated is the cathode.

Furthermore, in accordance with the invention, a method for producing a chromium layer by electrolytic deposition of chromium from an electrolyte by means of direct current and the use of an anode and a cathode is provided, with the aforedescribed electrolyte according to the invention being used.

In this process, the metallic chromium can be available in the form of one or more molds in the electrolyte. The mold can be shaped as described above.

In one embodiment, the metallic chromium is placed in the electric field of the anode and cathode. The dissolution of the metallic chromium is thereby facilitated over a long time period.

In one embodiment, the metallic chromium has contact to the anode. In this process, the metallic chromium and the anode can come into contact with one another, so that they can physically touch. Form-stable anodes, which are combined with soluble chromium metal anodes, where required, can be used as the anode, so that soluble chromium metal anodes as such or advantageously in combination with known dimension-stable anodes can be used. In particular, the anode is a precious metal containing mixed oxide anode, for example, a precious metal containing iridium mixed oxide anode. The dissolution of the metallic chromium is thereby achieved over a long time period in a convenient manner.

The two measures of inserting the metallic chromium into the electric field and the contact of the metallic chromium with the anode can be combined with one another, whereby the dissolution of the metallic chromium in the electrolyte can be monitored particularly well and a particularly convenient dissolution speed can be set.

In one embodiment, the surface area of the metallic chromium can be 1% to 50% of the surface area of the anode. In this manner, a particularly good dissolution of the chromium and a subsequent supply of Cr(III) is achieved.

The chromium layer can be produced at a pH value of 2.0 to 4.5. As already described above in connection with the composition of the electrolyte according to the invention, the pH value can be set by the above compound of formula (I).

Furthermore, the chromium layer can be produced at a temperature of 20° C. to 60° C. This, for example, can be achieved in that the temperature of the electrolyte is set to a value within this range by means of corresponding heating and cooling devices.

In addition, the chromium layer can be produced at a current density of 5 to 60 A/dm$^2$.

It is also possible that the electrolyte is moved, namely, for example, in such a manner that a circulation of five bath volumes, i.e. volume of the electrolyte, occurs per hour. As devices known per se for depositing chromium layers on objects can be used for this process, the volumes of the electrolyte baths of these devices known per se serve as the basis for the determination of the bath volumes in the method according to the invention.

When performing the electrolysis process, the object to be coated can be moved at a speed of 0.3 to 2.0 m/s.

Object of the invention is further a method for keeping the chromium(III) content in an electrolyte constant during electrolysis, with the electrolysis being performed by using the electrolyte according to the invention. Keeping constant is understood to mean that the Cr(III) content only changes by ±10%.

Furthermore, a method for preventing the formation of chromium(IV) during and after the electrolytic deposition of chromium is provided, with the electrolyte according to the invention being used.

These two methods can be equally conducted as the method according to the invention for producing a chromium layer by electrolytic deposition of chromium from an electrolyte.

With the electrolyte according to the invention or the use according to the invention and the method according to the invention, the Cr(III) content is, while electrolysis is taking place, kept more or less constant in the electrolyte at least over a longer time period of several hours up to several days and several months and Cr(III) is subsequently supplied to the electrolyte being depleted of Cr(III), without Cr(VI) being produced in this process.

Furthermore, chromium coatings of a particularly excellent quality are obtained, which surprisingly meet the requirements especially placed upon gravure cylinders.

As container that can be used as the electrolysis cell, any vessel eligible for a person skilled in the art can be used as, in particular, usually used in electroplating technology.

For the electrolysis, the object to be coated, on which the chromium layer is to be deposited, is generally used as the cathode. As anode for the electrolytic coating, anodes known per se to a person skilled in the art can be used. The anode can be a flat material, sheet material, sintering material or expanded material. As insoluble anodes, such anodes can, for example, be used which are selected from the group of platinum plated titanium, graphite, stainless steel, with iridium transition metal mixed oxide coated titanium, tantalum or niobium, or special carbon material and combinations of them. As anode material, a titanium, niobium or tantalum sheet coated with mixed metal oxides can be used. Furthermore, mixed metal oxide anodes can be used, as already described above, in particular, made of iridium ruthenium mixed oxide, iridium ruthenium titanium mixed oxide or iridium tantalum mixed oxide. Furthermore, the anode can be a mixed oxide anode in which the titanium, as the anode basic material, is coated with platinum, iridium or palladium oxide.

The shape of the anode can accordingly be adjusted to the relevant purpose by a person skilled in the art.

The following examples are meant to further illustrate the invention. It is pointed out that these examples only serve to illustrate the present invention. They should in any case not be understood to restrict the invention to these examples.

Example 1

An electrolyte with the following composition was provided:

chromium(III) sulfate (density=1.26 g/ml; 3% Cr(III)→37.8 g/l→0.727M) 18.61

Na sulfoacetate (8.3%→104.6 g/l→0.568M) 6.27 kg

Na formate (8%→100.8 g/l→1.482M) 6.05 kg

Na sulfate, 1.7%→21.4 g/l→17 mM) 1.29 kg

One liter of electrolyte in a beaker was heated to 40° C. with constant stirring and a pH value of 3.1 was set. Thereafter, the electrodes were inserted into the beaker in parallel opposite to one another and connected to a power source. The anode was a mixed oxide coated (MMO) titanium expanded metal. As the cathode, a copper metal strip was used. The cathode surface area was selected such that the working current density was, given a current of 3 ampere, approximately 20 A/dm$^2$. The anode surface area equals to the cathode surface area. Furthermore, a metallic chromium nugget was mounted on the anode so that it is conductively connected to the anode.

Comparative Example 2

Comparative example 2 was conducted similar to example 1, with the difference that a chromium nugget was not used.

Results

At the points in time 0, 2, 4, 6 and 8 hours, a 1.0 ml sample was taken in each case and the Cr(III) amount determined. It was noted that the Cr(III) amount decreased significantly quicker in comparative example 2 than in example 1. This suggests that the metallic chromium dissolves. This was confirmed by a gravimetric examination of the cathode and of the chromium nuggets before and after electrolysis.

The invention claimed is:

1. An electrolysis cell for the electrolytic deposition of chromium as a metal, comprising:

an electrolyte filling the electrolysis cell;

an anode immersed in the electrolyte; and a cathode immersed in the electrolyte, wherein the electrolyte comprises a chromium(III) salt and metallic chromium, wherein the metallic chromium is placed in an electric field of the anode and the cathode, wherein the metallic chromium is a metallic chromium nugget mounted on the anode such that the metallic chromium nugget is conductively connected to the anode;

wherein the anode is a form-stable anode;

wherein a surface area of the metallic chromium nugget is 1% to 50% of a surface area of the form-stable anode, wherein the chromium(III) salt prevents formation of Cr(VI) when the metallic chromium dissolves during electrolysis, wherein the electrolysis cell is devoid of a membrane separating the anode from the cathode.

2. The electrolysis cell of claim 1, wherein the electrolyte further comprises:

a compound of the formula (I)

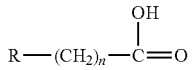

(I)

wherein R stands for $NH_2$, OH or $SO_3H$ and n is an integer ranging from 1 to 3, and/or its salts, in particular, salts with monovalent cations such as $Na^+$ and/or $K^+$ or bivalent cations, and/or formic acid and/or its salts, in particular, salts with monovalent cations such as $Na^+$ and/or $K^+$ or bivalent cations.

3. The electrolysis cell of claim 1, wherein the chromium (III) salt includes an inorganic and/or organic chromium(III) salt, wherein the inorganic chromium(III) salt is selected from the group consisting of potassium chrome alum, ammonium chrome alum, chromium sulfate, chromium sulfamate (amido sulfonate), chromium bromide, chromium iodide, chromium phosphate, chromium pyrophosphate (diphosphate), chromium phosphonate, chromium hydroxy sulfate (alkali chromium sulfate), chromium chloride and mixtures of two or more of them, or wherein the organic chromium(III) salt is selected from the group consisting of chromium citrate, chromium formate, chromium oxalate, chromium methanesulfonate, chromium dimethanesulfonate and mixtures of two or more of them.

4. The electrolysis cell of claim 1, wherein the electrolyte further comprises an additive.

5. The electrolysis cell of claim 4, wherein the additive comprises a complexing agent and/or a wetting agent.

6. The electrolysis cell of claim 1, wherein the anode is a precious metal containing iridium mixed oxide anode.

7. The electrolysis cell of claim 1, wherein the electrolyte further comprises a sulfate.

8. The electrolysis cell of claim 7, wherein the sulfate is Na sulfate and/or K sulfate.

9. The electrolysis cell of claim 7, wherein an amount of the sulfate is in a range of 5 mM to 30 mM.

10. The electrolysis cell of claim 1, wherein the surface area of the form-stable anode equals to a surface area of the cathode.

* * * * *